US007354496B2

(12) United States Patent
Rose et al.

(10) Patent No.: US 7,354,496 B2
(45) Date of Patent: Apr. 8, 2008

(54) METHOD FOR MANUFACTURING DOUBLE-WALLED LINER

(75) Inventors: Thomas Rose, Surrey (CA); Harvey Daviduk, Delta (CA)

(73) Assignee: Layfield Group Limited, Richmond (CA)

( * ) Notice: Subject to any disclaimer, the term of this patent is extended or adjusted under 35 U.S.C. 154(b) by 451 days.

(21) Appl. No.: 10/885,113

(22) Filed: Jul. 7, 2004

(65) Prior Publication Data

US 2006/0005894 A1 Jan. 12, 2006

(51) Int. Cl.
*B29C 53/52* (2006.01)

(52) U.S. Cl. ..... 156/201; 156/203; 156/204; 156/213; 156/215

(58) Field of Classification Search ..... 156/201, 156/203, 204, 212, 215, 213
See application file for complete search history.

(56) References Cited

U.S. PATENT DOCUMENTS 1,956,287 A * 4/1934 Henkel ..... 383/108
2,347,439 A * 4/1944 Shea et al. ..... 493/194
3,094,083 A * 6/1963 Weeks ..... 156/93
3,850,724 A 11/1974 Lehmacher
3,881,417 A 5/1975 Mesia
4,019,438 A 4/1977 Swanson, Jr.
4,182,242 A 1/1980 Mesia
4,410,383 A 10/1983 Lipari

* cited by examiner

*Primary Examiner*—Richard Crispino
*Assistant Examiner*—Barbara J. Musser
(74) *Attorney, Agent, or Firm*—McCarthy Tétrault LLP

(57) ABSTRACT

A double-walled liner and an apparatus and method for manufacturing said liner, wherein the outer liner of the double-walled liner is seamed longitudinally and transversely, and wherein the apparatus includes: a frame; a supply section for providing webs of inner and outer liner material; a folding section for folding the webs and including a V-form frame structure comprising mutually converging arms which converge towards an apex.

14 Claims, 14 Drawing Sheets

METHOD FOR MANUFACTURING DOUBLE-WALLED LINER

BACKGROUND OF THE INVENTION

1. Field of the Invention

The present invention relates to a double-walled liner and method and apparatus for the manufacture thereof. By way of example, the double-walled liner according to the present invention may be deployed as a borehole liner.

2. Description of the Prior Art

In the mining industry, blasting is considered to be one of the most cost-effective ways to fracture rock. Generally, blasting loosens the rock so it can be excavated. The rock is fractured enough to displace it and break it down to the size of the intended use. The blasting process requires drilling a borehole into the rock, placing an explosive into the borehole as a charge, and including a detonator or fuse to initiate the blast by setting off the charge.

Various explosives may be used as charges, such as dynamite or ammonium nitrate and fuel oil, known as "ANFO" to those in the mining arts. Oftentimes water collects in boreholes, either from rain or surface water or from underground sources, which has a deleterious affect on ammonium nitrate. Although wet ammonium nitrate will detonate, the detonation quality in fragmentizing rock is far from satisfactory. As a result boreholes are commonly lined with a borehole liner in the nature of a waterproof, plastic liner to keep the water away from the explosive. To maintain their waterproof integrity, it is necessary that borehole liners be resistant to cuts or abrasions caused by the often sharp inside surfaces of a borehole when a liner is lowered into the borehole.

Double-walled liners are desirable as they may provide greater durability, strength and resistance to moisture than single-walled liners. One of the ways of manufacturing double-walled liners is presented by U.S. Pat. No. 3,881,417. This patent reference discloses a borehole liner comprising a flattened, flexible, waterproof inner tube with a waterproof seal at its lower end, and an outer sheath which sheaths the inner tube and is substantially coextensive with the inner tube. A drawback of this process, however, is that the double-walled borehole liner is manufactured by manually inserting one tubing into another, a process that under most circumstances is time-consuming, labour intensive, and requires a large assembly area.

It is an object of this invention to attempt to mitigate or obviate at least one of the above-mentioned disadvantages.

SUMMARY OF THE INVENTION

In one of its broad aspects the present invention provides a double-walled liner comprising an inner liner having an open end and a seamed terminal and a longitudinally-seamed outer liner having an open end associated with the open end of the inner liner and a seamed terminal associated with the seamed terminal of the inner liner.

In another of its broad aspects, the present invention provides an apparatus for folding a flexible sheet over a flexible inner liner material, the apparatus including: a supply source for providing a web of a flexible outer liner sheet mated with a web of a flexible inner liner; a folding section for receiving the mated webs, the folding section including a V-form frame structure comprising mutually-converging arms, whereby the folder folds the outer liner longitudinally such that the outer liner envelops the inner liner; and a seamer for receiving the folded mated webs and seaming the longitudinal edges of the outer liner together. Advantageously, this apparatus allows the assembly process to take place in a small area, provides greater flexibility than the manual process and results in reduced manufacturing costs.

In yet another of its broader aspects, the invention provides a method for manufacturing a double-walled liner.

BRIEF DESCRIPTION OF THE DRAWINGS

These and other features of the embodiments of the invention will become more apparent in the following detailed description in which reference is made to the appended drawings, by example only, and not by way of limitation, wherein:

FIG. 6(*b*) is a cross-sectional view of the folder including a web of sheeting material and a web of tubing material taken along line D-D' in FIG. 4 at stage 2;

FIG. 6(*c*) is a cross-sectional view of the folder including a web of sheeting material and a web of tubing material taken along line D-D' in FIG. 4 at stage 3;

FIG. 8(*b*) is a front view of the liner of FIG. 8(*a*);

DESCRIPTION OF THE EMBODIMENTS

Figure 1:
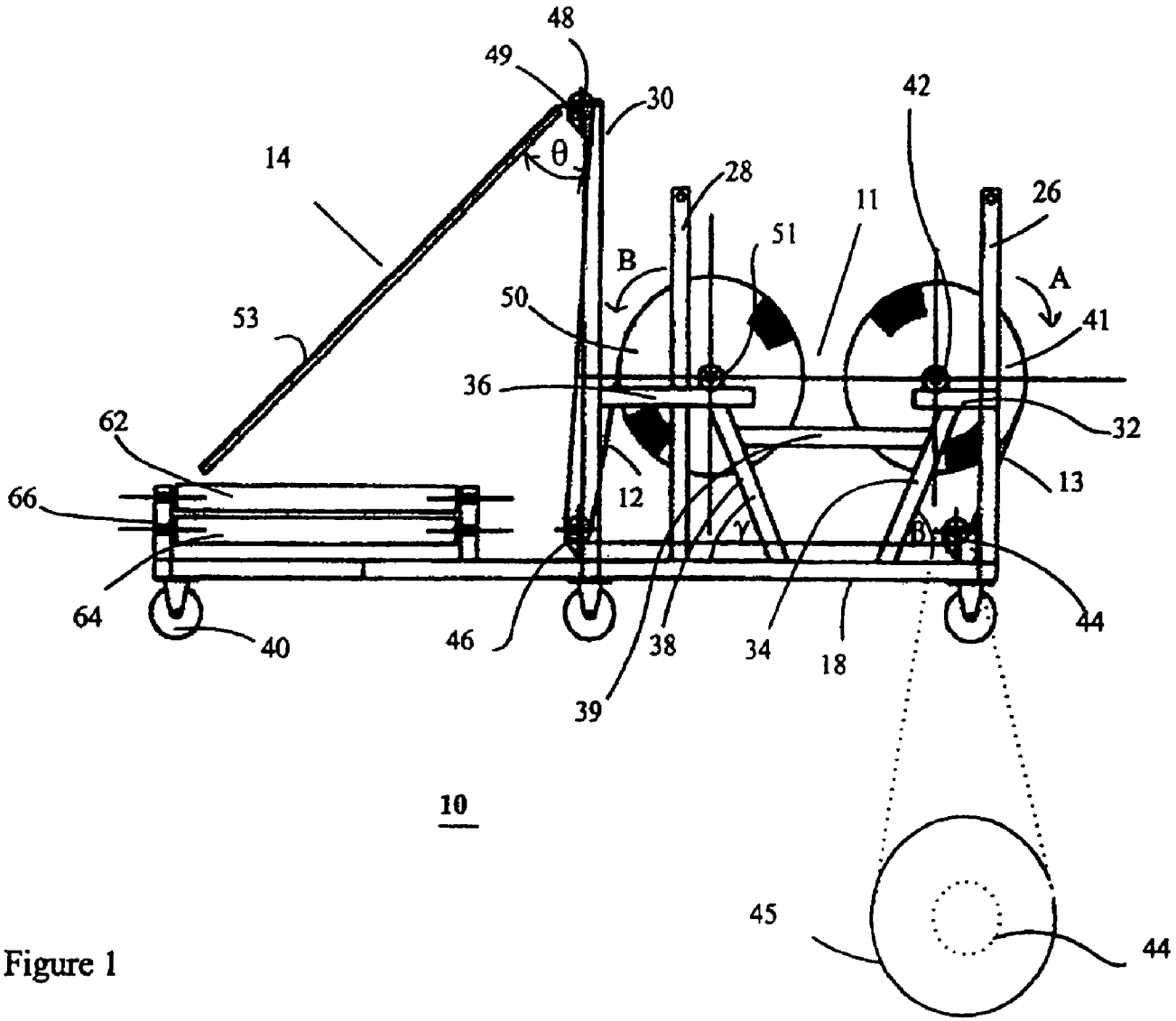
FIG. 1 is a side view of a double-walled liner apparatus.
Figure 2:
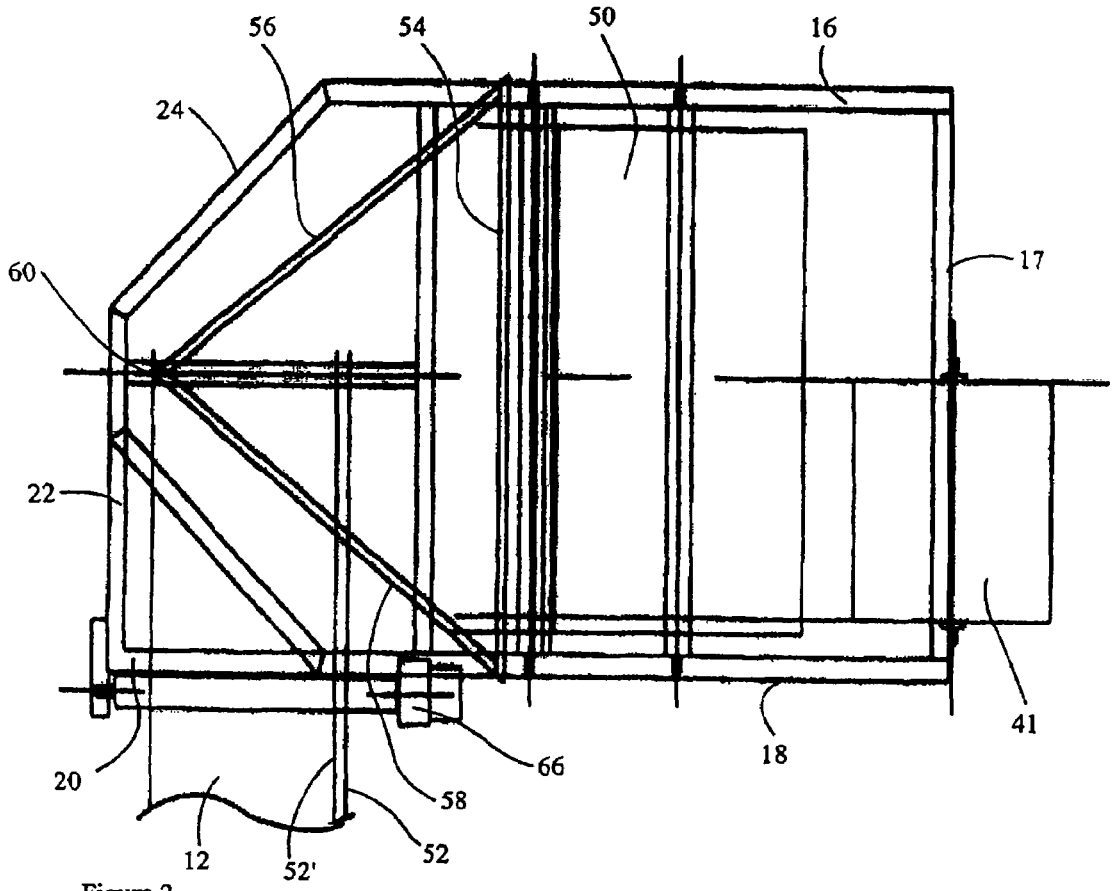
FIG. 2 is a top view of the double-walled liner apparatus of FIG. 1.
Figure 3:
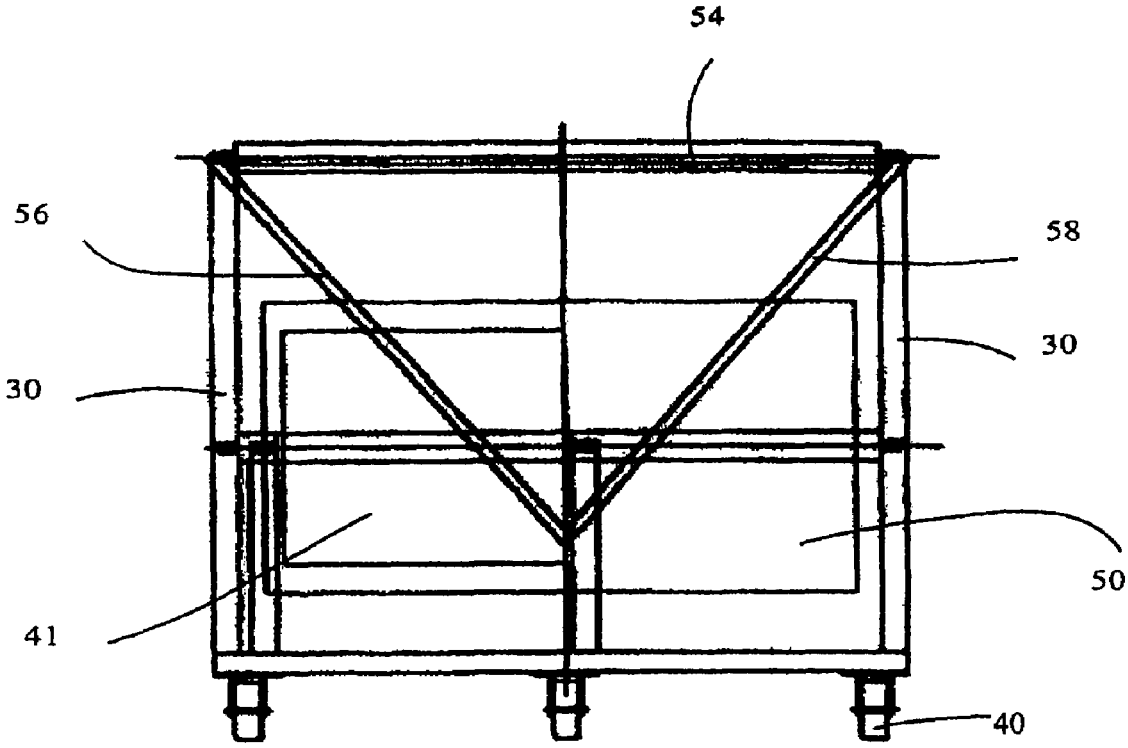
FIG. 3 is a front view of the double-walled liner apparatus of FIG. 1.

An apparatus 10 for fabricating a double-walled liner 61 according to an illustrated embodiment of the present invention includes a supply section 11, a folding section 14, and an output calendaring section 66. The double-walled liner 61 may be a borehole liner as described in greater detail below. The apparatus 10 may also optionally comprise a seaming section and a finishing section. The supply section 11 comprises a first and second supply source for respective first and second membrane or web feedstock, for instance in the form of a pair of first and second supply source reels 41, 50. The apparatus may additionally comprise a framework 15, or other like support structure, to which the first and second supply source reels 41, 50 may optionally be mounted. The framework 15 includes lower frame members, upright members and braces. In the embodiment illustrated in FIGS. 1, 2, 3 and 4, the framework 15 comprises lower frame members 16, 17 18, 20, 22, and 24, upright members 26, 28 and 30, and pairs of braces 34 and 38. Further, in the illustrated embodiment, arms 32 and 36 support first and second supply source reels 41 and 50. Framework 15 preferably includes a plurality of wheels 40 to facilitate movement of the apparatus 10 to a desired operating location.

In operation, a first membrane or web feedstock, namely the inner liner material 13, is paid off from supply source reel 41 (in a direction indicated as Arrow A), such as may be a reel of sheet feedstock, and fed about a first take-up idler pulley or guide roller 44. In one embodiment, stops 45 at either end of guide roller 44 keep the inner liner 13 in alignment during conveyance through the machine 10. The inner liner feedstock 13 is then directed toward a second idler pulley or guide roller 46 (which likewise may also be equipped with stops), where it is mated with a second membrane or web feedstock, namely the outer liner material 12, which pays off a second supply source reel 50, in a direction indicated as Arrow B. The two webs run together around the second idler pulley or guide roller 46 (which is preferably equipped with stops 49) and then up to, and about, an upper roller mounted on an upright member 30, said upper roller being indicated as folding section infeed roller 48. In one embodiment the feedstock on the supply source reels may be polyethylene, although any flexible materials that are impermeable to fluids may be used.

The folding section includes a generally triangular or V-form folding framework 14, surmounting the underlying framework structure 15. The framework 14 forms an angle with the vertical of between approximately 0 and 90 degrees, inclusive, more preferably between approximately 30 and 60 degrees inclusive, and most preferably between approximately 40 and 50 degrees inclusive. The selection of the angle of the framework 14 may depend on such factors as the amount of friction between the surface of framework 14 and the inner and outer liners or the tension of the inner and outer liners when the apparatus 10 is in operation.

Framework 14 includes a pair of left and right hand break members 58 and 56, respectively, mounted to extend obliquely and in a mutually converging orientation with respect to the infeed path of the mated feedstock webs. The break members meet at an apex 60 located generally centrally with respect to the longitudinal edges of the incoming mated webs as observed at the folding section infeed roller 48, an altitude of the triangular or V-form structure so formed tending to extend perpendicularly relative to the axis of rotation of the folding section infeed roller 48. The centerline C of the folding section 14 extends from the apex 60 to bisect the base arm 54, forming an altitudinal bisector. In alternative embodiments of the invention, the base arm 54 may be absent, such that the folding section infeed roller 48 may comprise a base to generally define a triangular framework from what would otherwise be a V-form folding framework.

The longitudinal edges 52, 52' of outer liner 12 flank the centerline C of the V-form or triangular framework 14, such that one longitudinal edge of the pair 52, 52' passes over the right hand break member 56, and the other passes over the left hand break member 58. The inner liner 13 is mated to the outer liner 12 in a sideways offset position, such that the inner liner 13 passes over one of the break members, for example the left hand break member 58. As the liners 12 and 13 are drawn forward, the location of the fold moves progressively toward the center of the outer liner 12, such that both folds meet at the apex 60, yielding a central crease in the outer liner 12 as it is drawn onward in the web feed direction. The inner liner 13 lies entirely to one side of that crease, and is itself folded longitudinally.

The outer liner 12 comprises longitudinal edges 52 and 52'. In one embodiment, the inner liner 13 comprises a tubing web having a circumference that is less than the width of the outer liner 12. In an alternative embodiment, the inner liner 13 comprises a sheeting web having a width less than that of the outer liner 12, wherein the inner liner sheeting web is folded longitudinally and the longitudinal edges 43 of the sheeting web are mated to one of the edges 52 or 52' of the outer liner on the framework 14, such that the inner liner fold 43' is adjacent to the crease of the outer liner 12.

Figure 4:
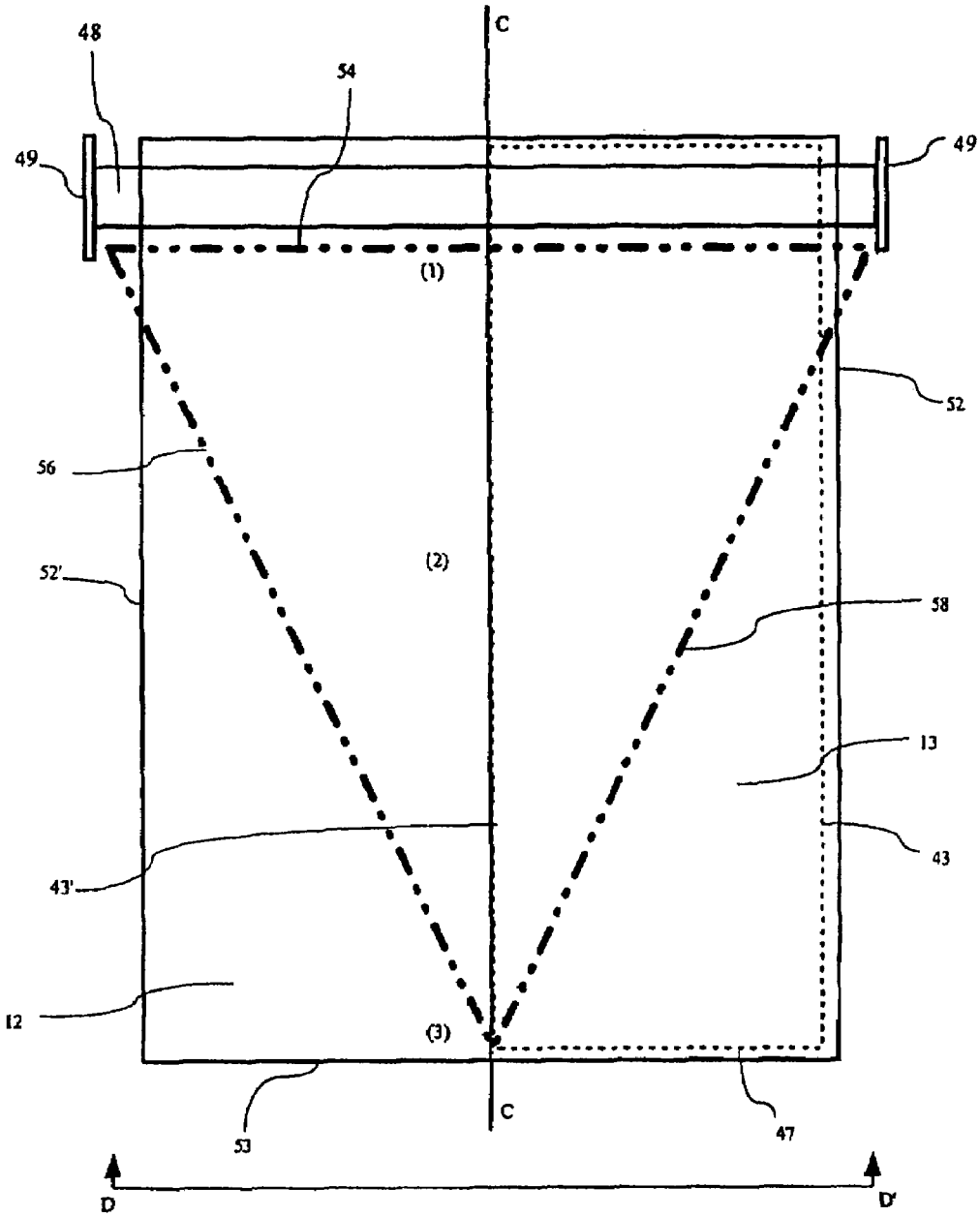
FIG. 4 is a top view of a folder of the double-walled liner apparatus of FIG. 1.
Figure 5:
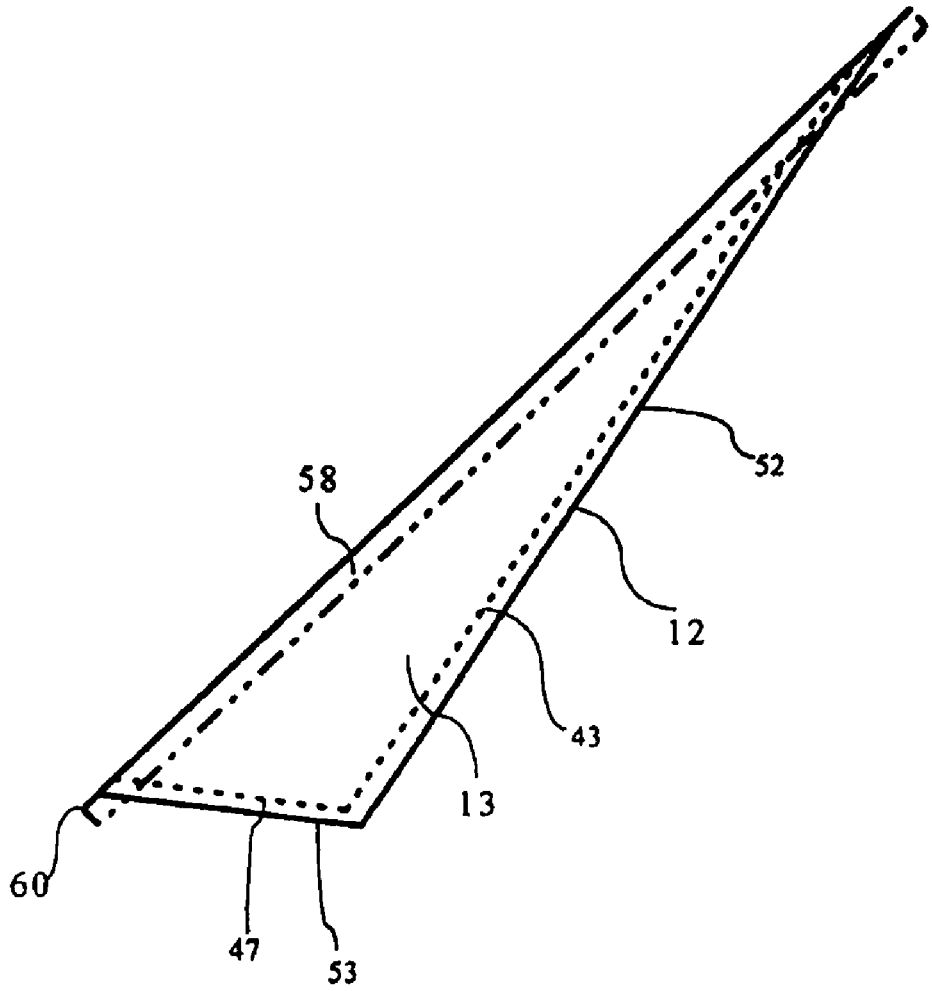
FIG. 5 a side view of the folder of FIG. 4.
Figure 6:
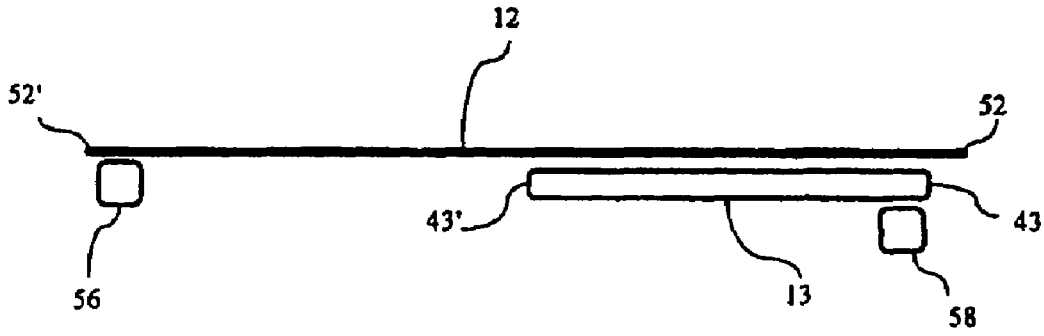
FIG. 6(*a*) is a cross-sectional view of the folder including a web of sheeting material and a web of tubing material taken along line D-D' in FIG. 4 at stage 1.
Figure 6B:
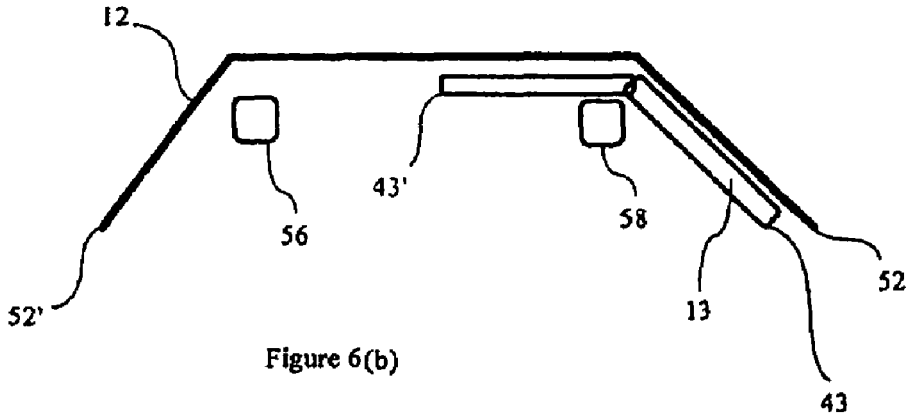
Figure 6:
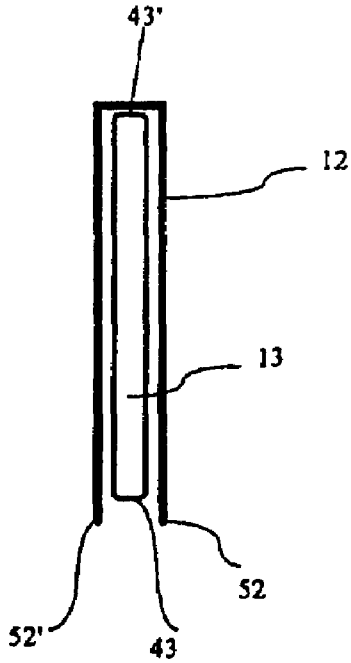

FIGS. 6(*a*), 6(*b*), and 6(*c*) show the configuration, in one embodiment, of the outer liner 12 and the inner liner 13 in cross-section taken along line D-D' in FIG. 4, at different stages on the triangular folding framework 14, while FIG. 5 shows a corresponding side view. FIG. 6(*a*) is a cross-sectional view of mated liners 12 and 13 at the infeed to the framework 14, wherein the inner liner 13 is mated in a sideways offset position relative to the outer liner 12 and the frame 14 and wherein the distance between break members 56, 58 is the greatest. FIG. 6(*b*) shows the mated liners at some point along the web feed path between infeed roller 48 and apex 60, wherein the distance between break members 56, 58 is less (as they are converging towards one another) and wherein the mated liners are folding over the break members 56,58. FIG. 6(*c*) shows the mated liners as they pass off apex 60 (not shown in this figure), wherein outer liner 12 folded is folded over inner liner 13 (and the crease is formed on outer liner 12 adjacent to edge 43 of the inner liner 13) and wherein outer liner edges 52, 52' are adjacent to one another.

Figure 9:
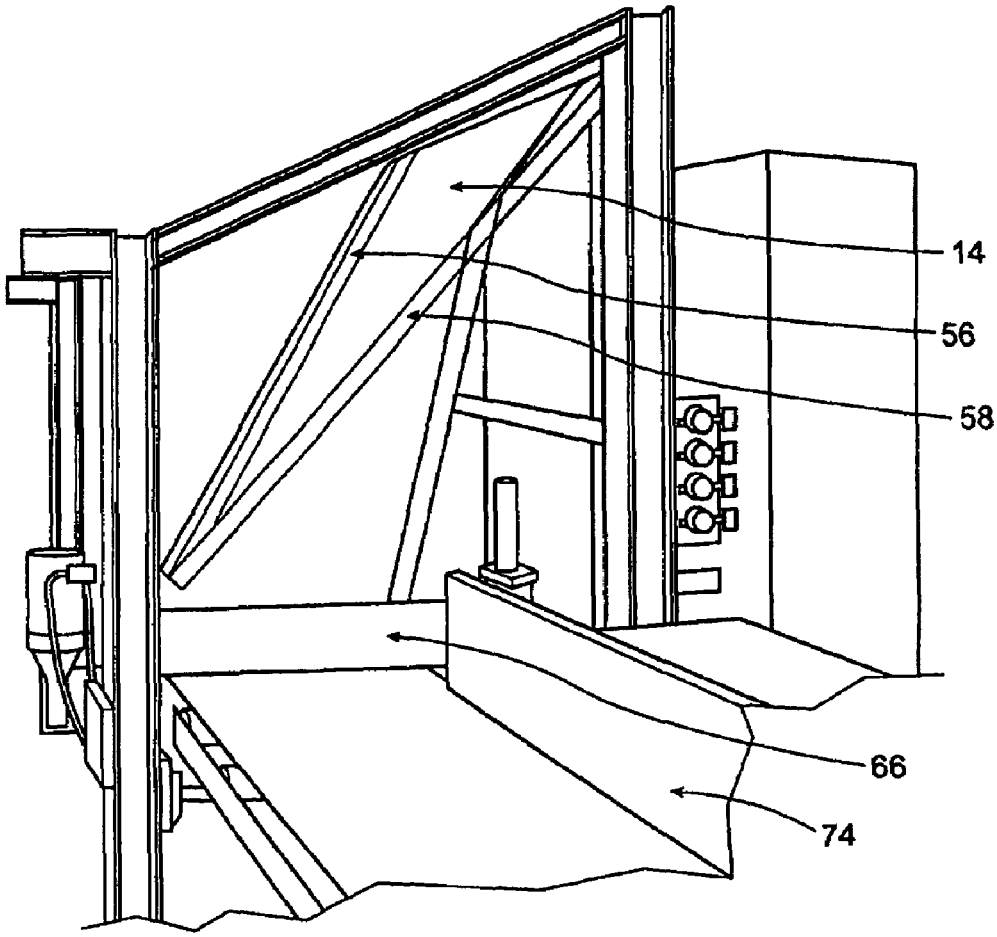
FIG. 9 is a perspective overhead view of the apparatus of FIG. 1.

In some embodiments of the invention such as one illustrated in FIG. 9, a pair of rollers 62 and 64 of calender 66 are positioned to receive the inner and outer liners 13 and 12 as they are drawn off the V-form or triangular framework 14, in order to press the liners together for increased ease of seaming by a seaming apparatus 74. As the mated inner and outer liners are drawn in the web feed direction, the calender rollers 62 and 64 compel edges 52 and 52' to finish the fold about the crease and to lie together. This means that the inner liner 13 is located between the folded halves of the outer liner 12, and results in a folded outfeed band.

Figure 10:
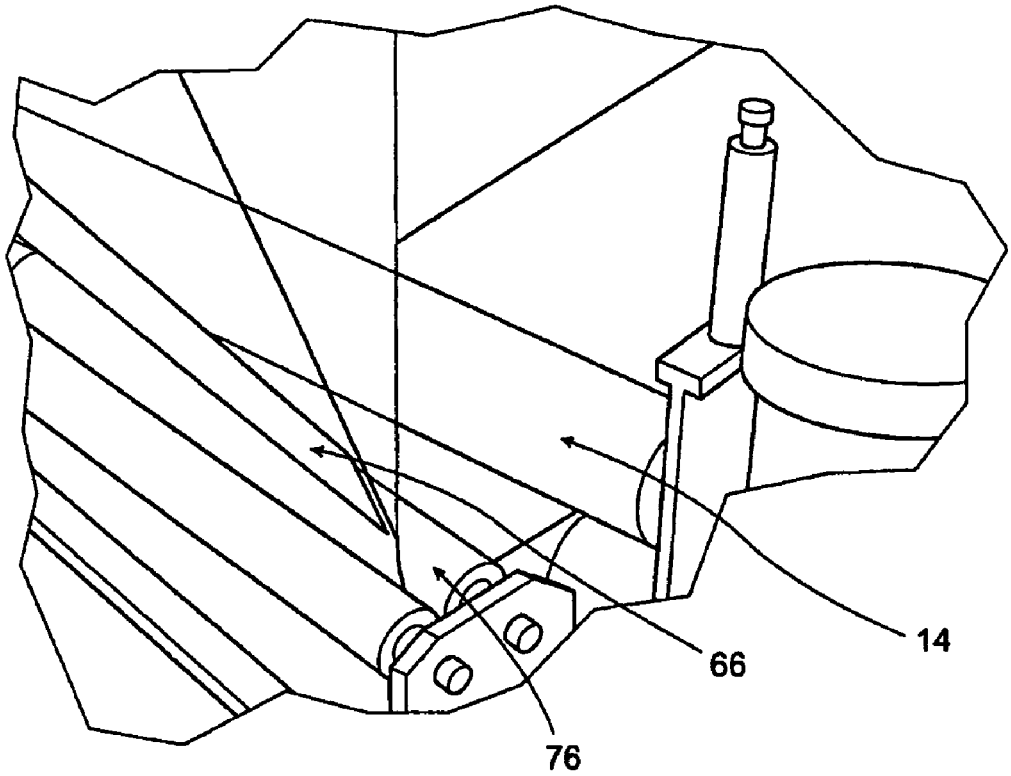
FIG. 10 is a perspective view of the outfeed guide and calender of the apparatus of FIG. 1.

In alternative embodiments such as one illustrated in FIG. 10, the mated inner and outer liners pass through one or more folding section outfeed guides 76 before entering into a calender (comprising, for example, calender rollers or plates). As the mated inner and outer liners are drawn along the web feed path, the outfeed guide 76 would compel edges 52 and 52' to finish the fold about the crease and to lie together, such that the inner liner 13 is located between the folded halves of the outer liner 12. The outfeed from the outfeed guide 76 is then passed between a pair of calender rollers. This results in a folded outfeed band.

Further, while it may be possible to achieve such a result with a single inclined outfeed guide 76, yet another alternative embodiment comprises two or more sequentially positioned outfeed guides 76, a pair of outside idler pulleys upstream of the outfeed guide 76, as well as a downstream roller positioned to cause the band to feed flat into the calender.

In further embodiments, the calender 66 may be replaced by one or more such outfeed guides 76, such that the outfeed from the outfeed guide 76 is the folded outfeed band. In such embodiments, the outfeed guides 76 serve to facilitate seaming of the outer liner 12 and inner liner 13 by the seaming apparatus 74.

In yet other embodiments, the calender 66 and outfeed guides 76 may be absent altogether.

Note that other folding apparatus could be used to achieve this result. That is, the crease need not create symmetrical left and right hand sides; instead, the folding apparatus could involve folding one side through 180 degrees, while the other side is maintained in a planar orientation. Further, the fold need not be in equal halves, but can be varied according to the position of the apex 60 of relative to longitudinal edges of the mated webs, as known to those in the art.

As shown in FIG. 9, this folded outfeed band is fed past the seaming apparatus 74, such as may be a large sewing machine or heat sealing device (the latter of which is depicted in FIG. 9), for seaming the longitudinal edges of the liners. In some embodiments, the outfeed band is guided into position for entry into the seaming apparatus 74 by one or more guide rollers or idler pulleys downstream of the calender 66.

In embodiments where the inner liner 13 comprises tubing, the width of the outer liner 12 preferably exceeds that of the inner liner 13, such that the edges 52 and 52' extend past inner liner edge 43 and only outer liner edges 52 and 52' are seamed. In such embodiments, the inner liner 13 and outer liner 12 of the finished double-walled borehole liner 61 are substantially longitudinally detached from one another and are advantageously separated by an air space. In these embodiments, the inner liner 13 and outer liner 14 may move somewhat independently of one another. Thus, for example, when the borehole liner 61 is dropped into a borehole, protrusions in such borehole may snag or even perforate the outer liner 12 without necessarily damaging the inner liner 13.

In another embodiment of the invention in which the inner liner 13 is a folded sheeting web, the longitudinal edges 43 of the inner liner 13 and the longitudinal edges 52 and 52' of the outer liner 12 are fed together through the seaming apparatus 74, resulting in a single longitudinal seam joining the longitudinal edges of the inner and outer liners. In alternative embodiments comprising a folded sheeting web inner liner 13, the longitudinal edges 43 of the inner liner 13 are seamed before the longitudinal edges of the outer liner 12; in such embodiments, there may be an additional seaming apparatus 82, for longitudinally seaming the inner liner 13, located upstream of the longitudinal seaming apparatus 74.

Figure 13:
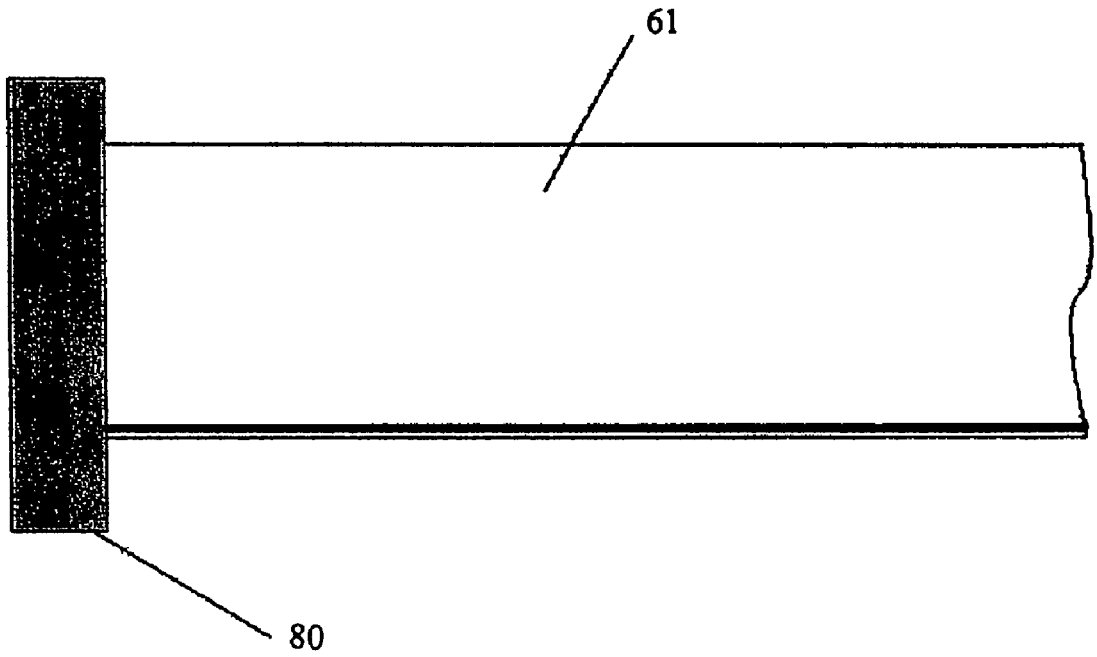
FIG. 13 is a top view of a cutter.
Figure 14:
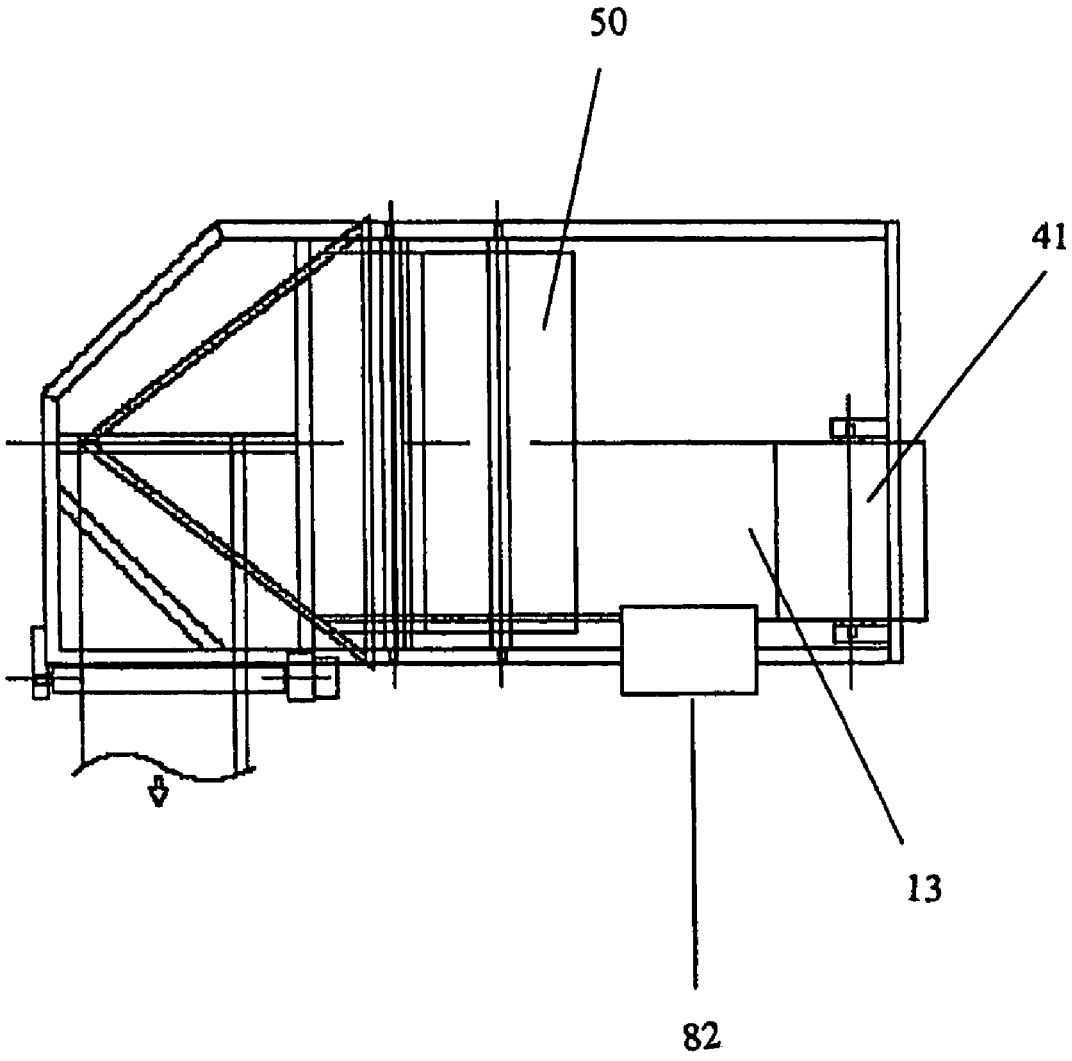
FIG. 14 is a top view of an alternative embodiment of the double-walled liner apparatus of FIG. 2.

Once longitudinally seamed, the outfeed band may be reeled onto an output reel, for transport to another location for further processing, or it may be directed to a downstream processing section. In some embodiments of the invention, the outfeed band passes around a turning bar and then onto a downstream processing section having an outfeed band feed path oriented perpendicularly to the seaming feed path; this, and similar alternative uses of turning bars and guide rollers to change the outfeed band feed path, can be used to decrease the amount of floor space taken up by the apparatus. Further processing includes cutting the outfeed band into desired lengths (as shown in FIG. 13), yielding double-walled tubes, with the inner liner 13 inside the outer liner 12, the length of the tubes being the distance in the web feed direction between the various divisions. Such cuts may be made using a separation device 80 such as, by way of example, a cut-off apparatus, burner, perforation device, and any device that can be used to facilitate transverse severing of the outfeed band. The present invention advantageously imposes no limitations on the length of such tubes; rather, the tube lengths are limited only by the supply section 11's capacity for liner material and whatever length is required for the application for which the double-walled liner is being made.

Figure 7:
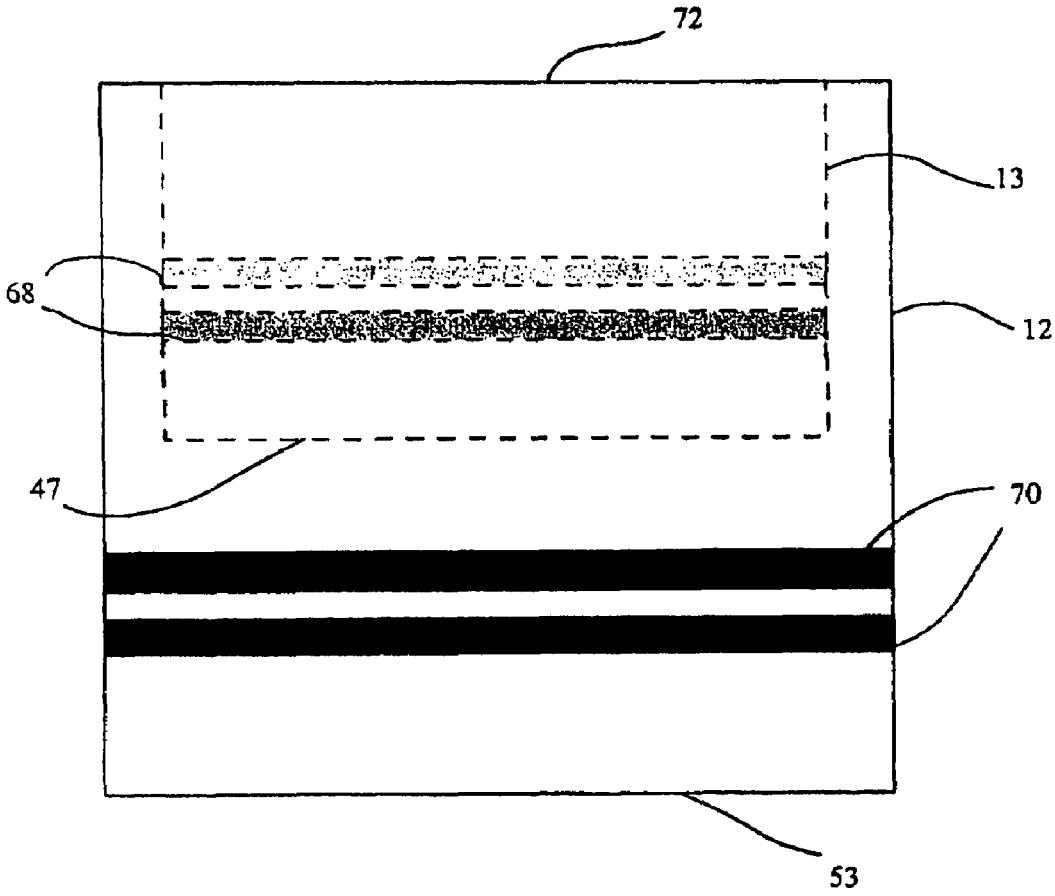
FIG. 7 is a double-walled liner as fabricated by the apparatus of FIG. 1.
Figure 11:
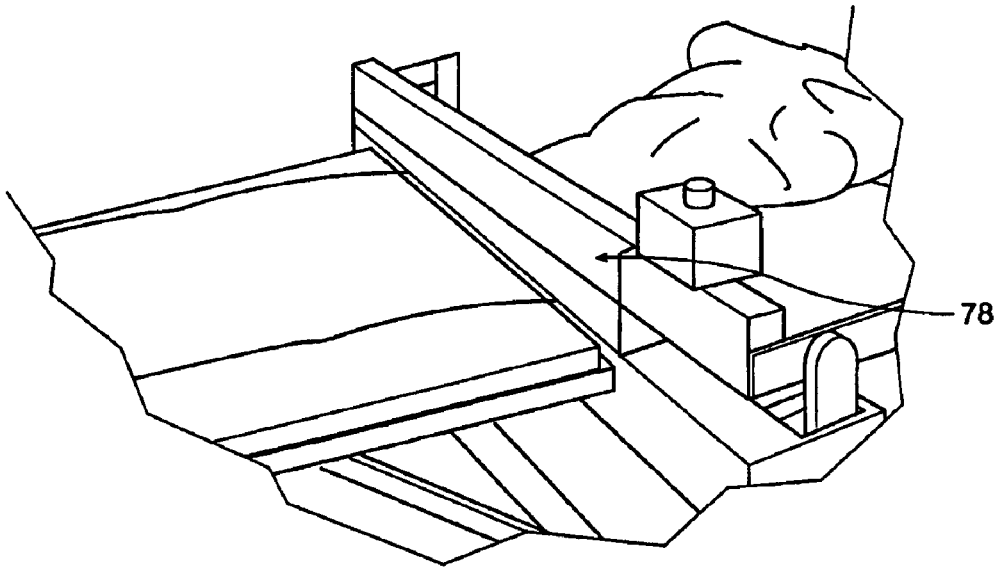
FIG. 11 is a perspective view of a transverse seamer.
Figure 12:
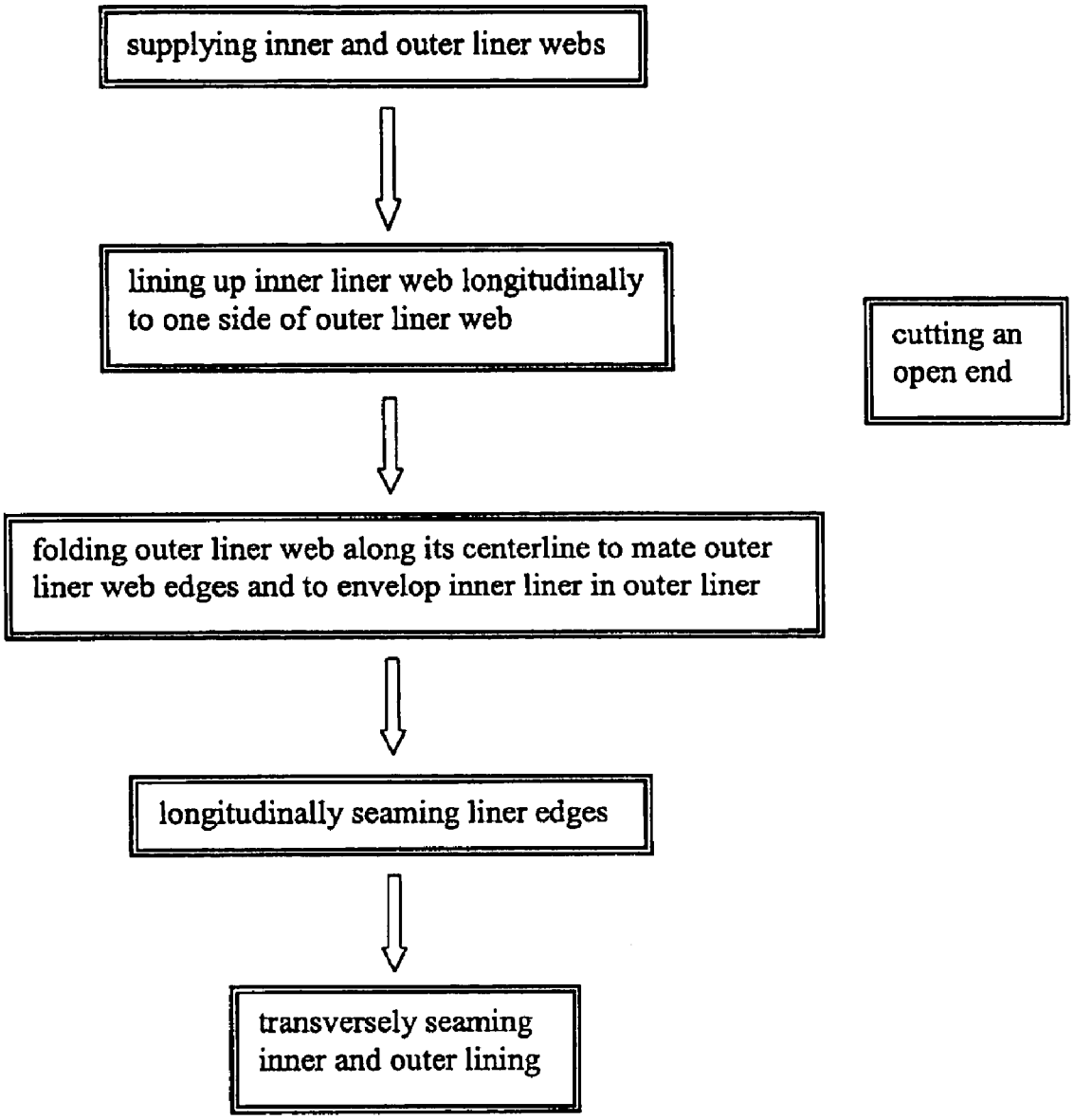
FIG. 12 is a flowchart of a method for manufacturing a double-walled liner.

After the outfeed band has been cut into a double-walled tube, the tube is seamed by a seamer, such as the transverse seamer 78 in FIG. 11 (as depicted therein, seamer 78 is a heat sealer), in the transverse direction; such seams are made to close an end of the tube. In some embodiments, these seams are substantially fluid-impermeable seals, and preferably have widths of at least ¼ inch, and more preferably about ¾ inch, to increase their reliability in ensuring the integrity of the resulting double-walled borehole liners. In some embodiments, the inner liner is seamed first, and then the outer liner is seamed, with the result that the transverse seamed end 47 of the inner liner 13 is enclosed within the transverse seamed end 53 of the outer liner 12. The embodiment illustrated in FIG. 7 comprises transverse seams 68 closing the end of the inner liner 13 and transverse seams 70 closing the corresponding end of the outer liner 12, thus forming the terminal of the double-walled borehole liner 61. The open end for both inner and outer liners of the double-walled borehole liner 61 is indicated in this figure by reference numeral 72. Conventional seamers may be employed to provide multiple transverse seams on the liners.

In another embodiment, the terminal of the double-walled tube is formed by seaming the inner and outer liners together.

Alternatively, the transverse seams may be made prior to separating the outfeed band into tubes. In such a case, each transverse seam would be common to the inner and outer liners, thus joining them together.

Figure 8:
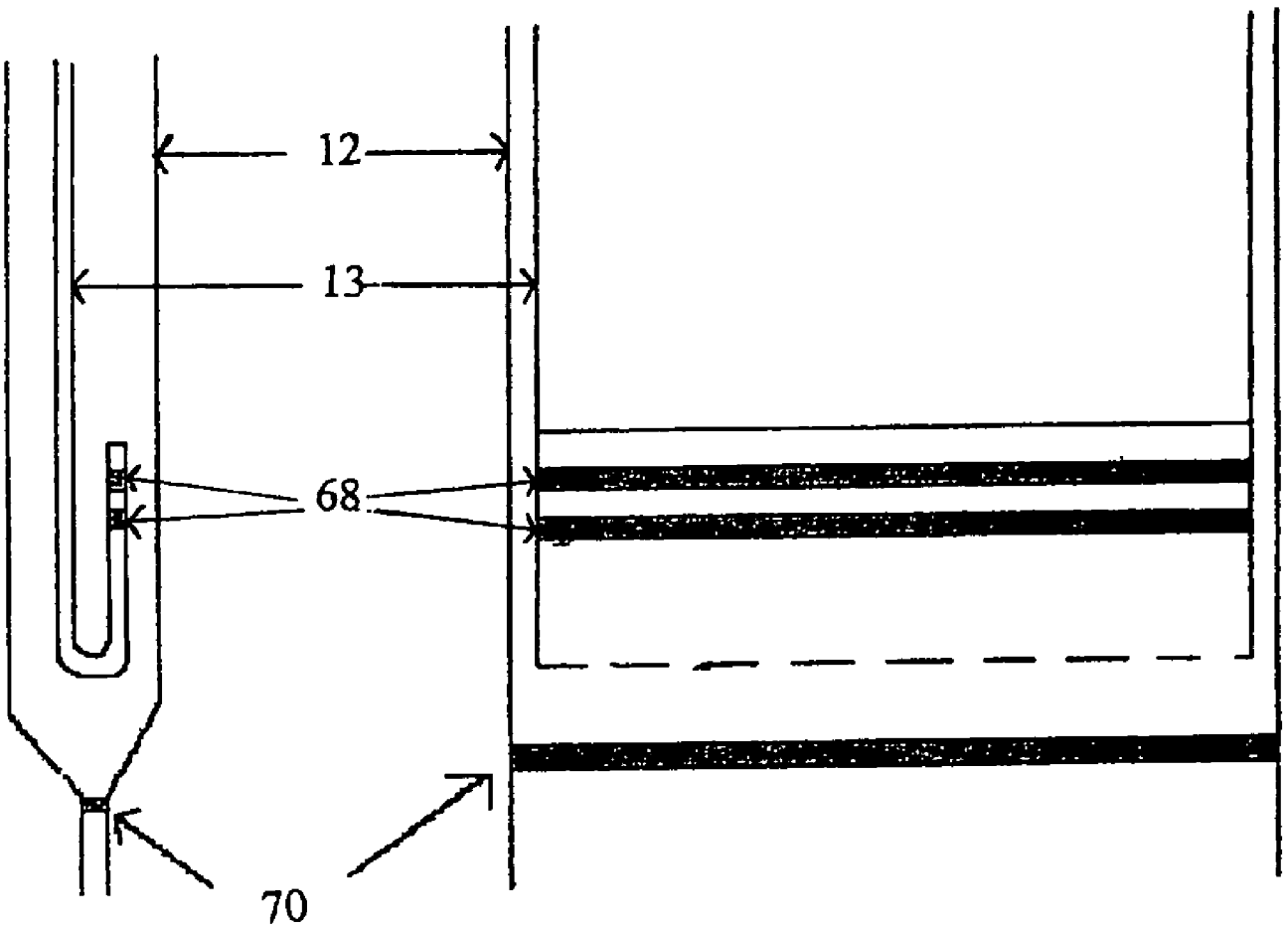
FIG. 8(*a*) is a side view of a double-walled liner having an inner liner with a folded terminal.

In embodiments of the invention in which the inner liner 13 is not longitudinally joined to the outer liner 12, the inner liner 13 is preferably transversely seamed first and then folded transversely upstream of the seam and tucked into the outer liner 12, which is then transversely seamed; this is depicted in FIGS. 8(*a*) and 8(*b*). In such embodiments, the distance between the transverse fold of the inner liner 13 and the transverse seam 68 is greater than the distance between the transverse fold of the inner liner 13 and the transverse seam 70 of the outer liner 12. Thus, the impact of any object (such as explosives) being dropped into the resulting double-walled borehole liner is borne by the transverse seam 70 of outer liner 12, thereby preserving the integrity of the inner liner 13.

While the embodiments of the invention relate to borehole liners, the double-walled liner of the invention has application outside the mining industry.

Although the product, method, and apparatus of the invention have been described with reference to certain specific embodiments, various modifications thereof will be apparent to those skilled in the art without departing from the spirit and scope of the invention.

The embodiments of the invention in which an exclusive property or privilege is claimed are defined as follows:

1. A method of making a double-walled liner, comprising:

supplying an outer liner web and an inner liner web, wherein the outer liner web includes sheeting material having two substantially longitudinal edges and a longitudinal centerline, and the inner liner web includes tubing material;

longitudinally lining the inner liner web substantially to one side of the outer liner web centerline, said inner liner web having a circumference less than the outer liner web width;

folding the outer liner web along its centerline such that said edges are placed adjacent to each other to envelop the inner liner web;

seaming the edges together; and transversely seaming the inner liner web and the outer liner web at one end thereof to form a closed terminal;

wherein the outer liner web is fed continuously from an outer liner web feedstock;

wherein the inner liner web is fed continuously from an inner liner web feedstock;

wherein at least one of the inner liner web feedstock and the outer liner web feedstock is a substantially liquid impermeable material;

wherein the inner liner web is fed in a form that is one of a hollow sheeting tube and a folded over longitudinally seamed sheeting web;

wherein said folding includes passing said outer liner web over a break, said break having a first break edge and a second break edge, a first portion of said outer liner being passed over said first break edge, a second portion of said outer web liner being passed over said second break edge;

wherein said folding includes passing all of said inner liner web over said first break edge in company with said first portion of said outer liner web; and, calendaring the folded over outer liner web and the inner liner web enveloped therewithin; and, wherein said break is a folder having a generally V-shape, one arm of the V defining said first break edge and the other arm of the V defining the second break edge, the arms of the V converging at an apex, and said folding includes passing the outer web from the broad end of the V toward the apex, and bending the outer web over the arms of the V.

2. The method of claim 1, further comprising cutting an open end distal to the terminal.

3. The method of claim 1 wherein said method includes feeding the outer liner web from a continuous reel of outer liner web feedstock.

4. The method of claim 1 wherein said method includes feeding the inner liner web from a continuous reel of inner liner web feedstock.

5. The method of claim 1 further comprising cutting the inner and outer liners to length to define individual double walled liners.

6. The method of claim 1 including employing a V having an angle from vertical of between 30 and 60 degrees.

7. The method of claim 1 further comprising cutting to length a continuous feed of the folded the inner and outer liners to define individual double walled liners.

8. The method of claim 7 wherein each individual inner liner and outer liner has respective open and transversely seamed ends, and the step of cutting to length includes cutting the distance between the open end and transverse seaming of the inner liner to be less than the distance between the open end and transverse seaming of the outer liner.

9. The method of claim 1 wherein one of said seaming steps includes forming a seam common to the inner and outer members.

10. The method of claim 1 wherein the transverse seaming includes forming at least one seam on the inner member and at least one seam on the outer member.

11. The method of claim 1 wherein the transverse seaming includes forming at least one substantially fluid-impermeable seal.

12. The method of claim 9 including forming a seal having a width of at least ¼ inch.

13. The method of claim 1 including heat sealing one of the longitudinal seams and the transverse seams.

14. The method of claim 1 including sewing one of the longitudinal seams and the transverse seams.

* * * * *